US008555461B2

(12) United States Patent
Hachtmann

(10) Patent No.: US 8,555,461 B2
(45) Date of Patent: Oct. 15, 2013

(54) DEVICE FOR CLEANING GROOVED SURFACES OF A MOVING TRANSPORT

(76) Inventor: William Hachtmann, Madera, CA (US)

( * ) Notice: Subject to any disclaimer, the term of this patent is extended or adjusted under 35 U.S.C. 154(b) by 227 days.

(21) Appl. No.: 12/943,184

(22) Filed: Nov. 10, 2010

(65) Prior Publication Data

US 2012/0110777 A1 May 10, 2012

(51) Int. Cl.
*A47L 9/04* (2006.01)

(52) U.S. Cl.
USPC ..... 15/354; 15/320; 198/495; 198/496

(58) Field of Classification Search
USPC ..... 15/354, 359, 333, 334, 302, 320, 340.2, 15/340.4; 198/494–496
See application file for complete search history.

(56) References Cited

U.S. PATENT DOCUMENTS 3,273,193 A * 9/1966 Soderholm et al. ..... 15/320
3,559,230 A * 2/1971 Ogle ..... 15/302
3,869,749 A 3/1975 London et al.
4,709,441 A * 12/1987 Center ..... 15/301
5,715,565 A 2/1998 Kern
6,079,077 A * 6/2000 Kajihara et al. ..... 15/332

* cited by examiner

*Primary Examiner* — Mark Spisich
*Assistant Examiner* — Andrew A Horton
(74) *Attorney, Agent, or Firm* — Kelly & Kelley, LLP

(57) ABSTRACT

The device for cleaning grooved surfaces of a moving transport, such as escalators and moving walkways, includes a frame supporting at least one vacuum pump and a plurality of vacuum heads and a plurality of brush heads. A carriage is attached relative to the frame to which at least one of the plurality of vacuum heads and brush heads are slidably attached. The carriage can be attached to the frame in a multitude of ways, including utilizing a four-bar linkage. The carriage is positionable between a stored position and a deployed position. Additionally, the carriage can be angularly adjustable to align with a horizontal plane of the grooved surface. A handle can be pivotably attached to the frame wherein pivotable movement of the handle is mechanically coupled to movement of the carriage between the stored and deployable positions.

36 Claims, 13 Drawing Sheets

DEVICE FOR CLEANING GROOVED SURFACES OF A MOVING TRANSPORT

FIELD OF THE INVENTION

The present invention generally relates to escalator cleaners. More particularly, the present invention relates to an escalator cleaner including a slidable brush head and vacuum head which can fully clean an entire width of an escalator in one pass.

BACKGROUND OF THE INVENTION

The movement of people in large groups (pedestrian traffic) can be facilitated through the use of escalators, moving walkways, and other similar mechanical devices. These mechanical means of transporting people can be used to transport a large group of people horizontally across a long distance or vertically along a series of moving steps. The advantage of such a device is that the walkway is constantly moving and thereby able to move a large amount of people very efficiently. In contrast, an elevator has the disadvantage that its movement is not continuous and must stop and reverse its direction to carry people in the opposite direction.

Due to their efficiency advantage, escalators and moving walkways have become popular within large buildings or structures such as airports, shopping malls, office buildings, theaters and the like. Escalators and moving walkways typically have a grooved surface for a pedestrian to stand upon. The grooved surface is a feature of the design that helps to maintain proper alignment during its operation. At the beginning and end of each escalator or moving walkway is the part of the device called the comb, which has a comb-like structure that fits within each of the grooves in the grooved surface. The comb remains stationary while each step or walkway section moves adjacent to it such that the transition from moving walkway to stationary walkway is seamless.

Without the grooved features that match the comb, the chance of serious bodily injury would rise. The machine components moving an escalator and walkway are extremely strong and dangerous. An escalator or moving walkway could easily kill or injure a person if a part of their body or part of their clothing was accidently caught by the moving components. For these reasons and many others, the comb and grooved surface design are necessary elements which cannot be removed. Unfortunately, these grooved surfaces are difficult to clean.

Typically the cleaning staff of a large building or structure will sweep, mop, polish, vacuum and clean the various walkways where pedestrian traffic has soiled them. Pedestrian traffic can leave marks on the floor, trash, or debris from food. For instance, food may be spilled in the floor, such as an ice cream cone. Typical cleaning techniques are adequate to clean an ice cream cone from a marble floor, but it is far more difficult to clean the grooved surfaces of an escalator or moving walkway where an ice cream cone has fallen. The grooves do not lend themselves to be easily cleaned. Also, half of the escalator is always hidden from cleaning further complicating the cleaning process. It is a waste of resources to have a person manually clean the escalator or moving walkway, when their time is better spent attending to more effective cleaning chores.

To help facilitate cleaning an escalator or moving walkway, various devices have been created which clean the escalator and moving walkway while it is motion. These devices are set up near the start of the moving portion of the escalator or moving walkway and are left to clean for a predetermined about of time while the escalator and moving walkway operate. Unfortunately, many devices can only clean a portion of the escalator or moving walkway, and then must be repositioned to clean an adjacent portion. This is because escalators and walkways come in different widths and sizes. Some escalators and moving walkways are narrower and typically move one person in width at a time. Other escalators and moving walkways are wide and can move two people in width at a time. It is therefore difficult to create a device that can clean all the different sizes of escalators and moving walkways currently used today.

The devices of the prior art must be set up to clean just a portion of the width of the escalator, and then later moved to clean an adjacent portion. This means that the center of the escalator might be cleaned twice, which then leaves an uneven appearance after cleaning has finished. Otherwise, special brush heads and vacuum heads must be separately purchased to match the specific size of a certain escalator. Changing brush heads and vacuum heads can be problematic and cumbersome. Also, vacuum heads which are too wide tend to have a low suction at the ends and therefore does a poor job of cleaning.

Accordingly, there is a need for an escalator and moving walkway cleaner that can easily adjust to fit and clean an entire width of the walkway in one pass. The present invention fulfills these needs and provides other related advantages.

SUMMARY OF THE INVENTION

The device of the present invention for cleaning grooved surfaces of a moving transport, such as escalators and moving walkways, includes a frame supporting at least one vacuum pump and a plurality of vacuum heads associated with the vacuum pump. A brush head can be associated with the plurality of vacuum heads. Alternatively, the brush head can include a plurality of brush heads. A carriage is attached relative to the frame to which at least one of the plurality of vacuum heads is slidably attached. Alternatively, at least one of the plurality of brush heads can also be slidably attached to the carriage.

The carriage can be attached to the frame in a multitude of ways, including utilizing a four-bar linkage. The carriage is positionable between a stored position and a deployed position. Additionally, the carriage can be angularly adjustable to align with a horizontal plane of the grooved surface.

A handle can be pivotably attached to the frame. Pivotable movement of the handle can be mechanically coupled to movement of the carriage between the stored and deployable positions. For instance, when the handle is in a down position it corresponds to the deployed position of the carriage, and when the handle is in an up position it corresponds to the stored position of the carriage. This allows one to easily store and deploy the carriage without lifting a large amount of weight which could injure a worker.

A rail support can be pivotably attached to the handle. The rail support abuts a base of a pair of railings of the conveying transport preventing movement of the device when the handle is in the down position and the rail support is in an extended position. Additionally, the rail support can be slidably positionable along a length of the handle such that it then properly fits the base of the pair of railings.

The device can include at least one wheel attached relative to the frame for positioning the device between a pair of railings of the conveying transport. Likely, the device would include a plurality of wheels for easily rolling it around between moving conveying transports that need cleaned.

A vacuum bag can be associated with the vacuum pump. Additionally, a plurality of vacuum bags can be associated with the vacuum pump or a plurality of vacuum pumps. An auxiliary vacuum hose can be associated with the vacuum pump for manually vacuuming a debris. A moveable switch plate can be associated with the plurality of vacuum heads and the auxiliary vacuum hose. Movement of the switch plate allows a suction to be varied between the plurality of vacuum heads and the auxiliary vacuum hose. Said differently, a means for switching a suction between the plurality of vacuum heads and the auxiliary vacuum hose can be facilitated. Furthermore, a sprayer can be associated with the frame for manually distributing a cleaning fluid.

In an exemplary embodiment, the carriage comprises an intermediate support connected to the frame through a linkage assembly. The linkage can be a multitude of designs and configurations. For instance, the linkage can comprise a four-bar linkage. Additionally, the carriage can be pivotably attached to the intermediate support and be angularly adjustable to align with a horizontal plane of the grooved surface. Furthermore, at least one of the plurality of brush heads can be interchangeable, such that different brush heads may be utilized for different cleaning techniques.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
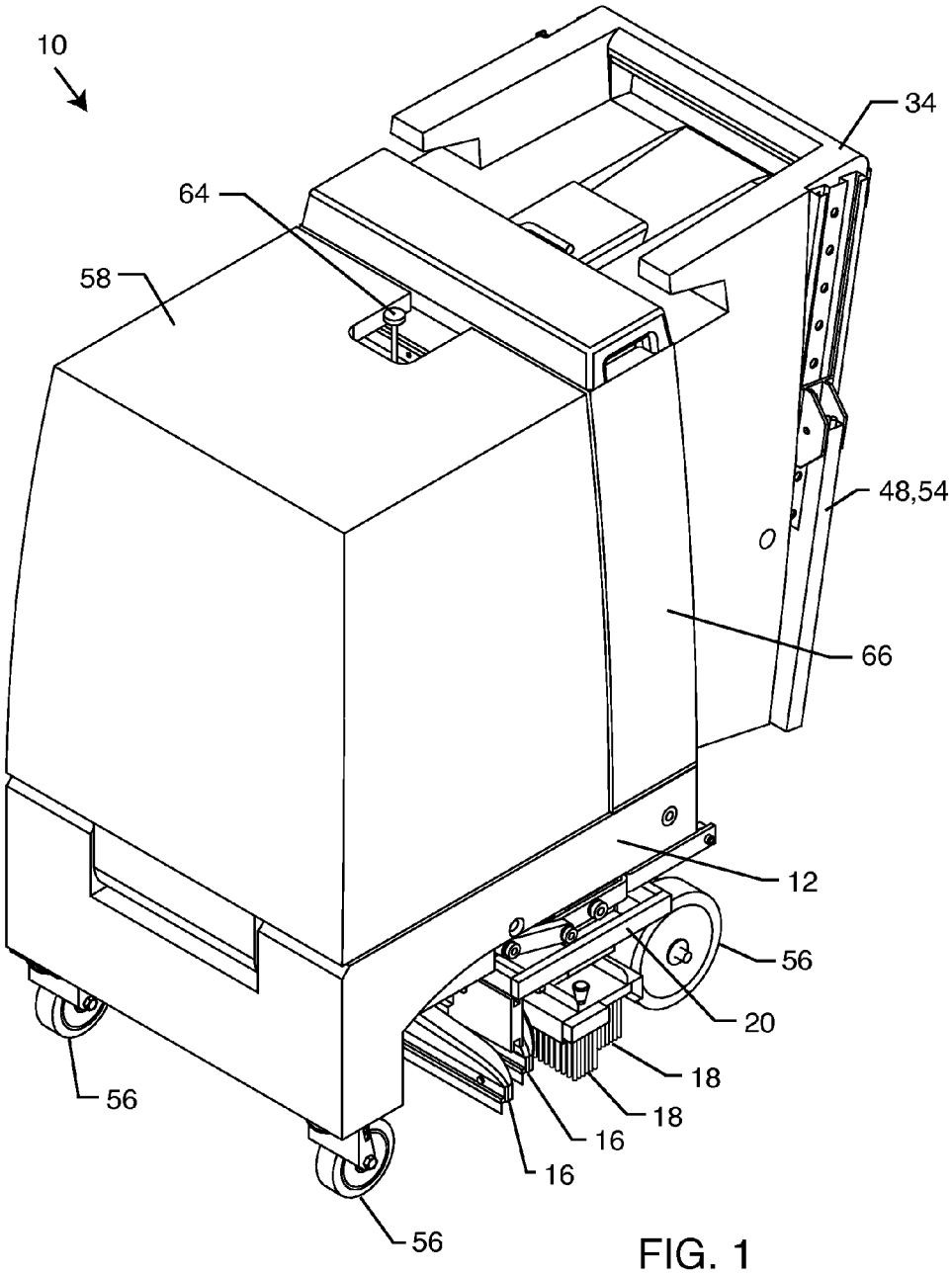
FIG. 1 is a perspective view of an exemplary device for cleaning grooved surfaces of a moving transport embodying the present invention.
Figure 2:
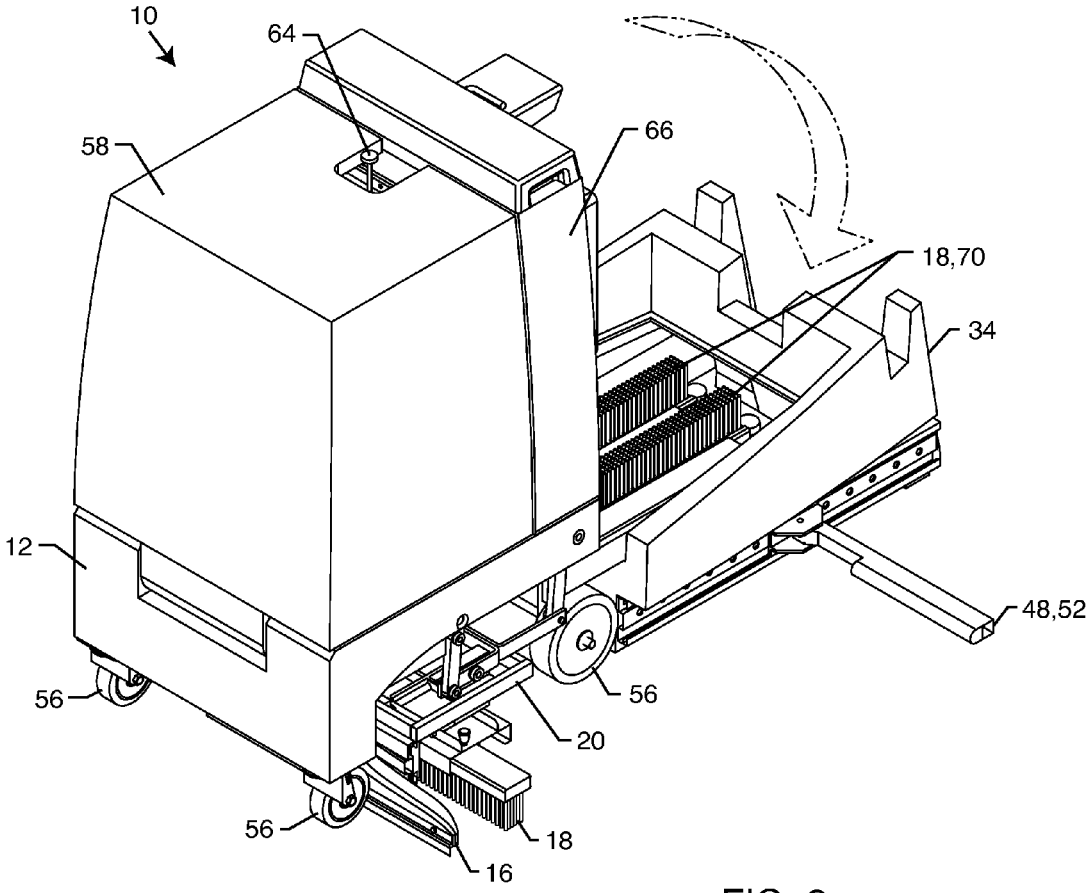
FIG. 2 is a perspective view of the structure of FIG. 1, now showing the handle in a down position.

As shown in the drawings for purposes of illustration, the present invention for a device for cleaning grooved surface of a moving transport is referred to generally by the reference number 10. The device 10 can be generally referred to as an escalator cleaner, and it is understood that it references all moving walkways utilizing grooved surfaces, such as moving walkways and the like.

Figure 3:
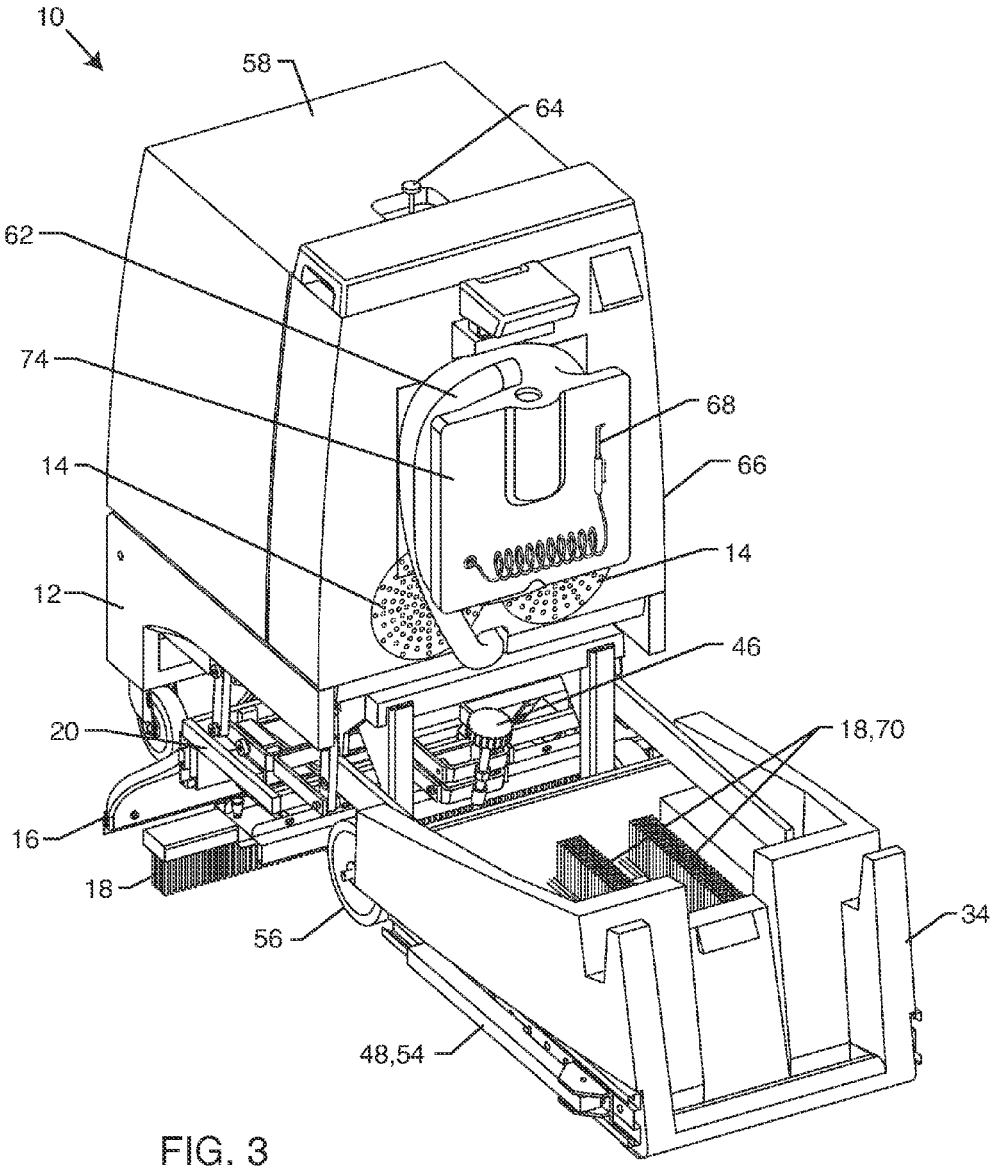
FIG. 3 is a perspective view of the structure of FIG. 2, now from a different direction.
Figure 4:
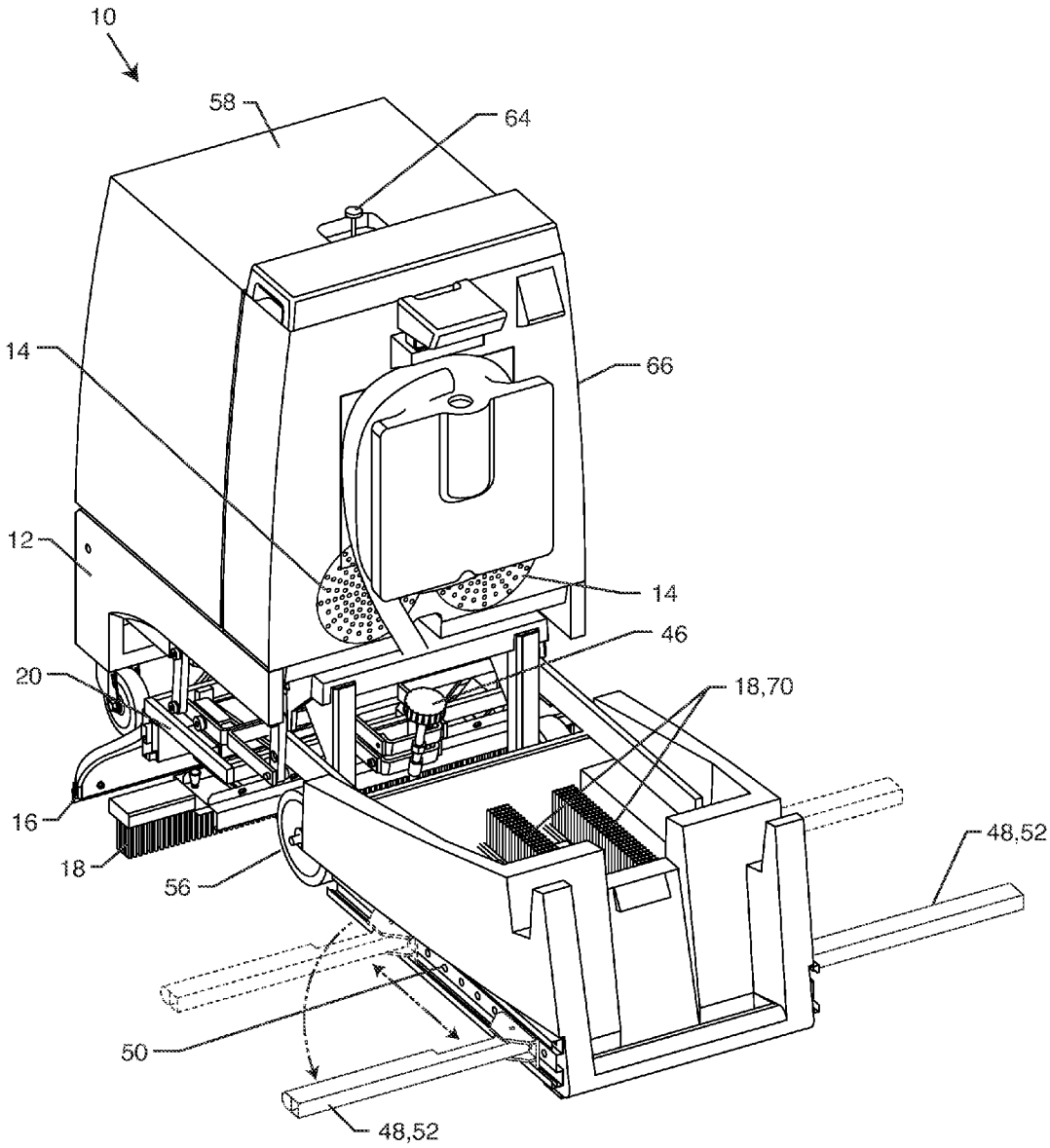
FIG. 4 is a perspective view similar to FIG. 3, now showing a rail support extended.

As shown in FIGS. 1-5, 9-13, and 14-15, the device 10 includes a frame 12. FIGS. 1-5 and 14-15 show the frame 12 as an exterior portion while FIGS. 9-13 show the frame 12 as an interior structural member. It is understood that the frame 12 can be configured in a multitude of ways and supports all the components of the device 10, such as the vacuum pumps 14 including all the circuitry, motors, and mechanisms required to make a vacuum pump 14 operate correctly. The frame 12 can support one vacuum pump 14, or a plurality of vacuum pumps 14. The vacuum pumps 14 are hard to see specifically as they are buried inside the frame 12 and structure as shown in FIGS. 3 and 4. The vacuum pumps can be battery powered, or powered from a connection to wall outlet.

The frame 12 also supports a vacuum head 16 and a brush head 18. More specifically, the frame 12 can support a plurality of vacuum heads 16 and a plurality of brush heads 18. The vacuum heads 16 are associated with the vacuum pumps 14. This means that suction is created at the vacuum head 16 by the vacuum pump 14 so that debris and other trash can be collected. In the exemplary embodiment shown and described herein, two vacuum heads 16 are used to collect debris. An advantage of using two vacuum heads 16 over a single long vacuum head 16 is that suction is lost the longer the vacuum head becomes. Suction at the far ends of each vacuum head 16 is lost and it degrades the ability to clean the moving transport. Therefore, the applicant's exemplary embodiments show two vacuum heads 16 that are shorter than a single long vacuum head 16 such that pressure at each portion along the vacuum head 16 remains effective.

A carriage 20 is attached relative to the frame 12 to which at least one of the plurality of vacuum heads 16 is slidably attached. Alternatively, at least one of the plurality of brush heads 18 can also be slidably attached to the carriage 20. In the exemplary embodiments shown and described herein, each vacuum head 16 and brush head 18 are slidably attached to the carriage 20. A button or a frictional stop can be used to slide each head 16,18 into place and then lock it securely. Many methods of sliding the heads 16,18 can be utilized by one skilled in the art and this disclosure is not intended to limit it to the precise form described herein. The advantage of utilizing a sliding head 16,18 is that they can be extended to cover any size of moving walkway in one single pass. This means that the device 10 can be set up just once to clean each walkway as repositioning is not necessary as is common with other existing cleaning devices.

Figure 14:
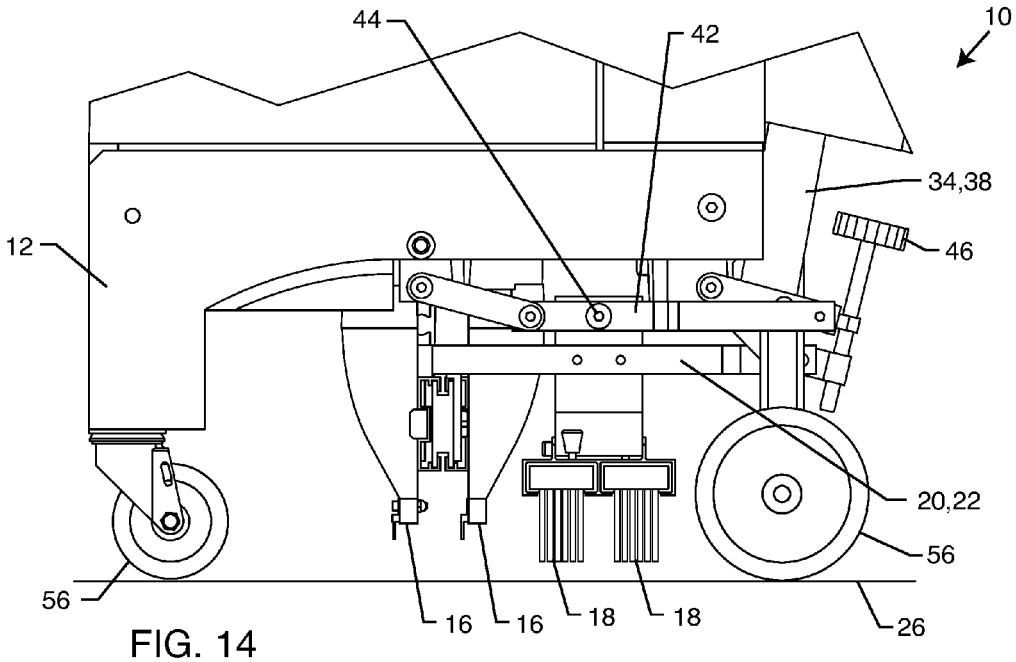
FIG. 14 is a partial and enlarged side view of the carriage assembly of the structure of FIGS. 10-13 in a stored position.
Figure 15:
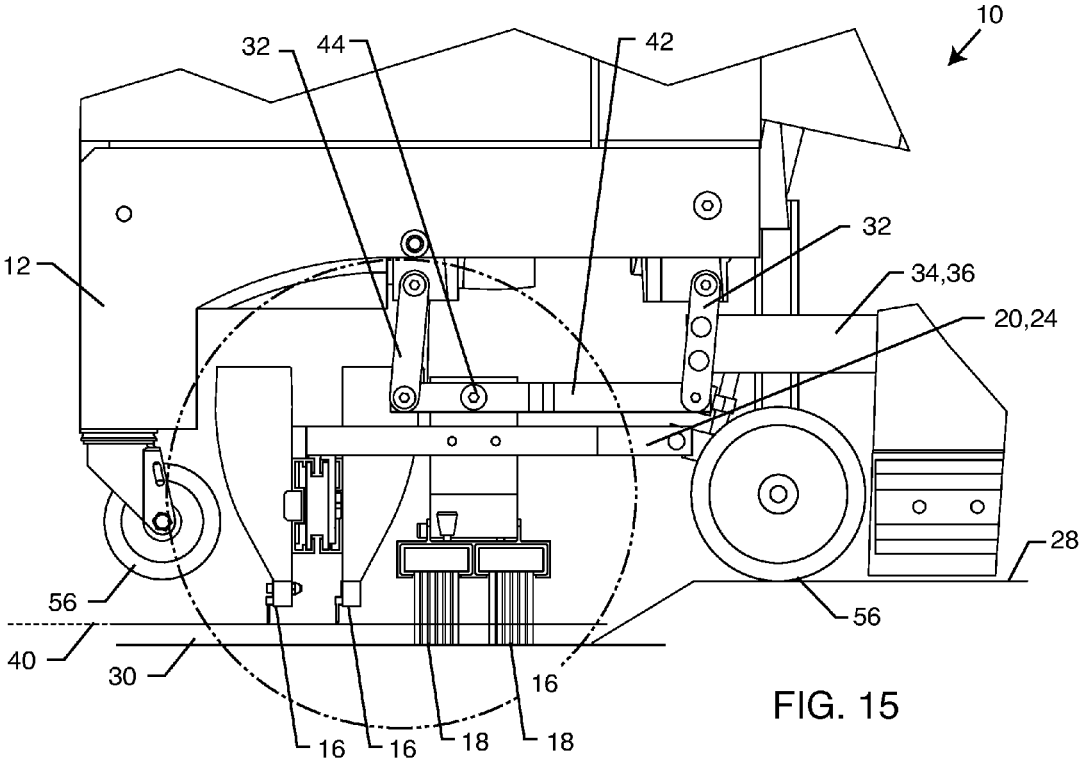
FIG. 15 is view similar to the structure of FIG. 14, now showing the carriage in a deployed position.
Figure 16:
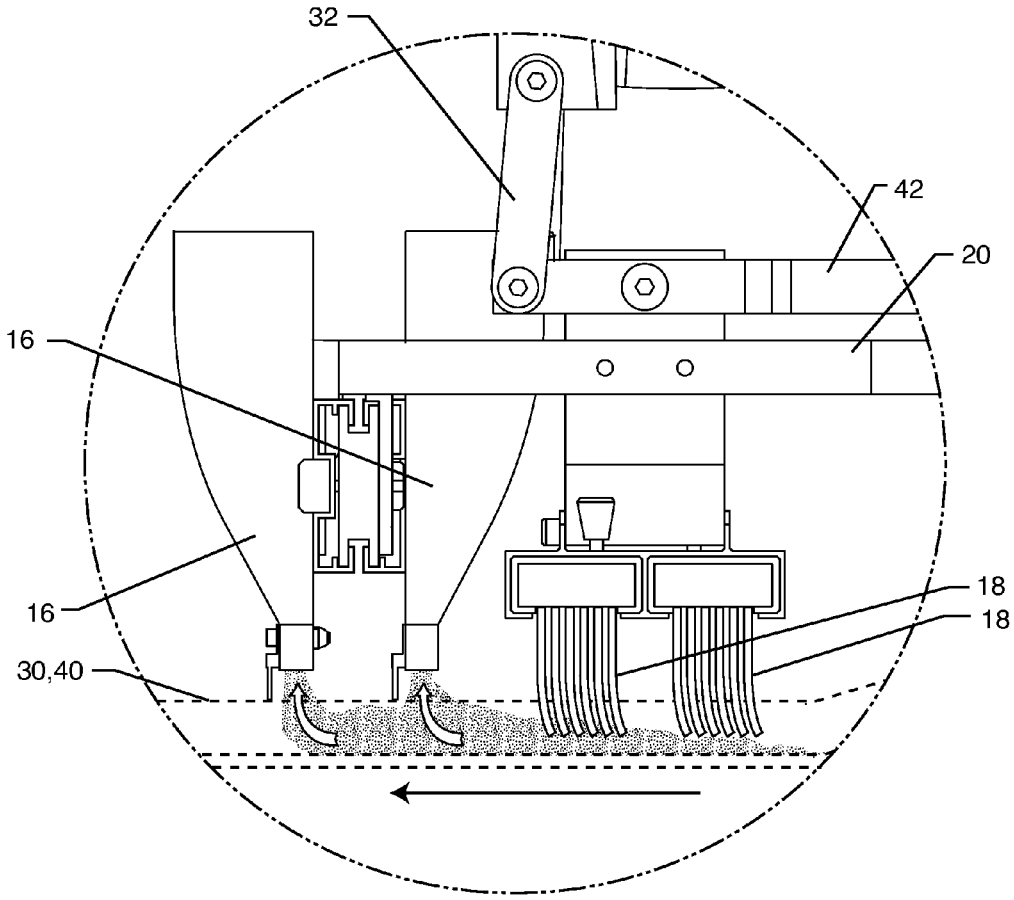
FIG. 16 is an enlarged side view of the structure of FIG. 15 taken along line 16.

The carriage 20 is positionable between a stored position 22 and a deployed positioned 24. The stored position 22 is shown in FIG. 14. The stored position 22 keeps the heads 16, 18 away from the floor 26 such that the device 10 can be rolled and moved around. FIG. 15 shows how the device would be used in operation where the heads 16, 18 are in a deployed position 24. The device 10 sits over the comb on top of the stationary portion 28 of the moving walkway, while the heads 16, 18 are against the grooves 30 of the moving portion of the moving walkway. As can be seen, the brush heads 18 penetrate further as compared to the vacuum heads 16 due to the individual bristles of the brush head 18 penetrating into the grooves 30. As the moving walkway moves, the brush heads 18 loosen and dislodge trash and other debris such that the vacuum heads 16 can then suction the debris away from the walkway.

The carriage 20 can be attached to the frame 12 in a multitude of ways, including utilizing a four-bar linkage 32. A handle 34 can be pivotably attached to the frame 12. Pivotable movement of the handle 34 can be mechanically coupled to movement of the carriage 20 between the stored 22 and deployable 24 positions. For instance, when the handle 34 is in a down position 36 it corresponds to the deployed position 24 of the carriage 20, which is shown in FIG. 15. When the handle 34 is in an up position 38, it corresponds to the stored position 22 of the carriage 20, which is shown in FIG. 14. This allows one to easily store and deploy the carriage 20 without lifting a large amount of weight which could injure a worker.

An exemplary embodiment of coupling the handle 34 and the carriage 20 through the four-bar linkage 32 is shown in FIGS. 14 and 15. The handle 34 is pivotably coupled to the rear of the four-bar linkages 32. When the handle 34 is moved, it forces the four-bar linkages 32 to move and thereby moves the carriage 20 either into the stored position 22 or deployed position 24. It can be seen by one skilled in the art that variations of the four-bar linkage 32 would allow the mechanical coupling of the handle 34 and the carriage 20, and this disclosure is not intended to limit it to the precise form described and shown herein.

The carriage 20 can also include a further feature where it can be angularly adjustable to align with a horizontal plane 40 of the grooved surface. Many escalators and moving walkways can be manufactured such that the stationary portion 28 is not perfectly parallel with the first section of the moving walkway. To account for manufacturing and installation irregularities, it is desired to allow the carriage 20 to further adjust such that a perfect alignment can be achieved where the vacuum heads 16 and brush heads 18 are aligned with the horizontal plane 40 of the grooved surfaces 30.

Figure 12:
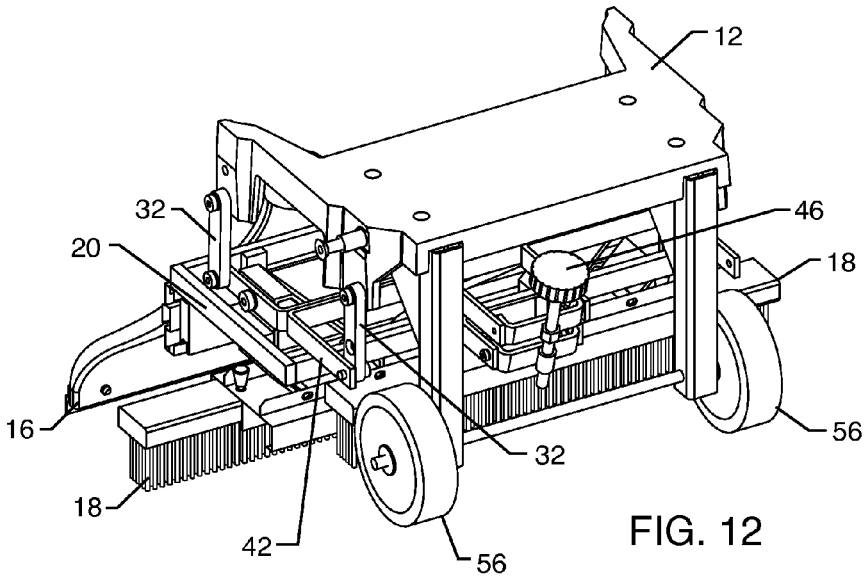
FIG. 12 is a perspective view similar to the structure of FIG. 10, now from a reverse direction.
Figure 13:
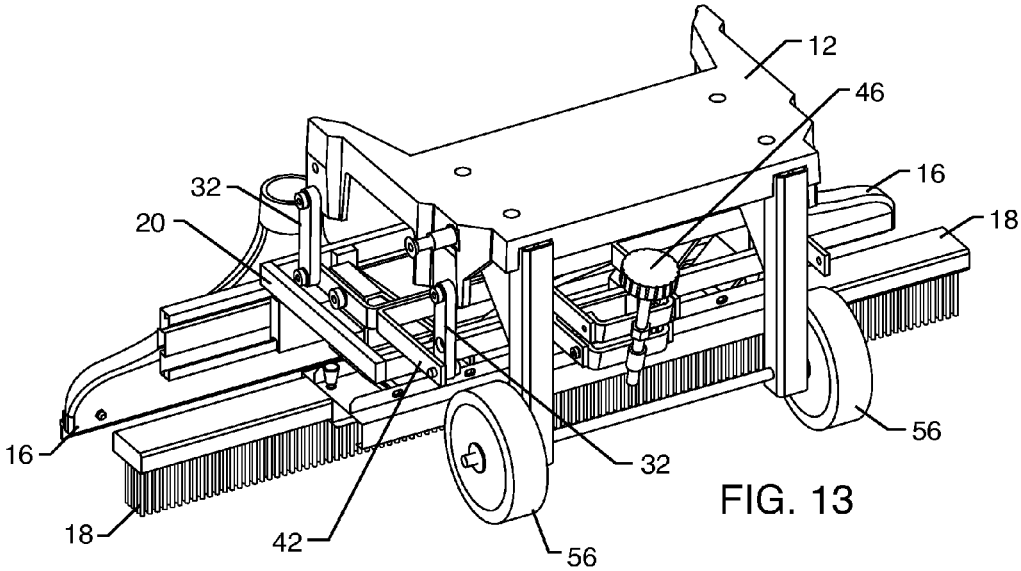
FIG. 13 is a perspective view similar to the structure of FIG. 11, now from a reverse direction.
Figure 17:
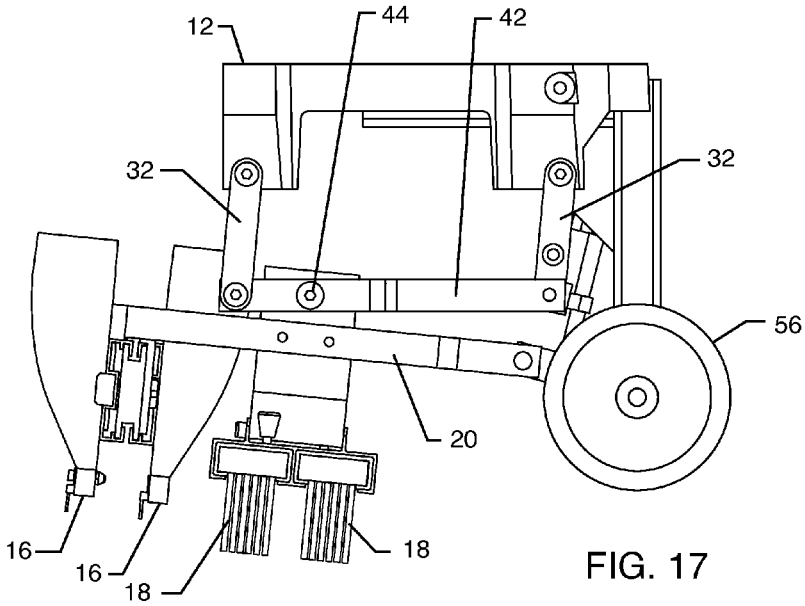
FIG. 17 is a partial side view of the carriage showing the angular adjustability.
Figure 18:
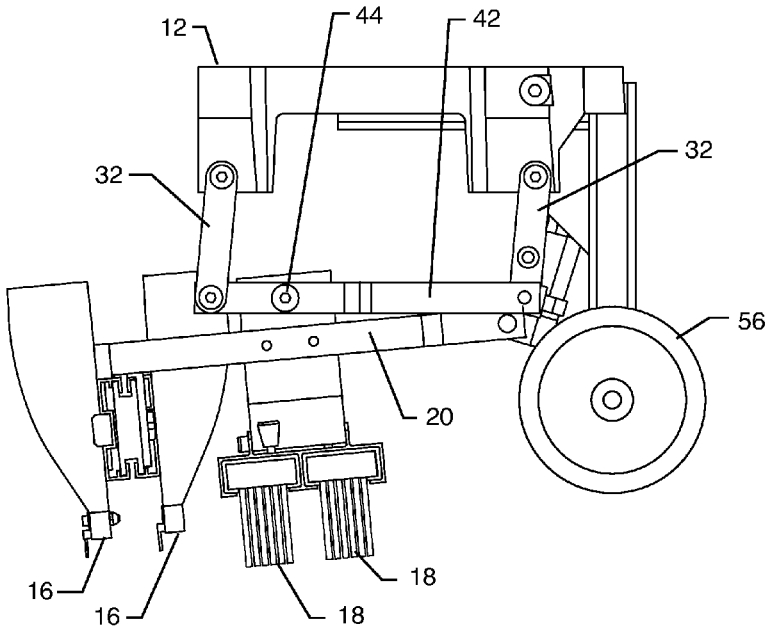
FIG. 18 is another partial side view similar to FIG. 17 showing the angular adjustability.

In an exemplary embodiment, the carriage 20 comprises an intermediate support 42 connected to the frame 12 through a linkage assembly. The linkage can be a multitude of designs and configurations. As previously disclosed, the linkage can comprise a four-bar linkage 32. The intermediate support 42 is connected to the four-bar linkage 32. The carriage 20 is then pivotably connected to the intermediate support 42. As best shown in FIGS. 17 and 18, the pivot point 44 allows the carriage 20 to angularly adjust with respect the intermediate support 42. A knob 46 facilitates the adjustment of the angle. The knob 46 is best shown in FIGS. 12 and 13. Rotation of the knob 46 forces the carriage 20 to pivot and angularly adjust with respect to the intermediate support 42, which also then means it has adjusted relative to the frame 12 and ultimately to the grooves 30.

Referring now to FIG. 4, a rail support 48 can be pivotably attached to the handle 34. The rail support 48 abuts a base of a pair of railings of the conveying transport preventing movement of the device 10 when the handle 34 is in the down position 36 and the rail support 48 is in an extended position 52. FIG. 3 shows the rail support 48 in a retracted position 54. Additionally, the rail support 48 can be slidably positionable along a length 50 of the handle 34 such that it then properly fits the base of the pair of railings. This allows for different lengths of stationary portions 28 which may be used.

The device 10 can include at least one wheel 56 attached relative to the frame 12 for positioning the device 10 between a pair of railings of the conveying transport. Likely, the device would include a plurality of wheels 56 for easily rolling it around between moving transports that need cleaned.

Figure 5:
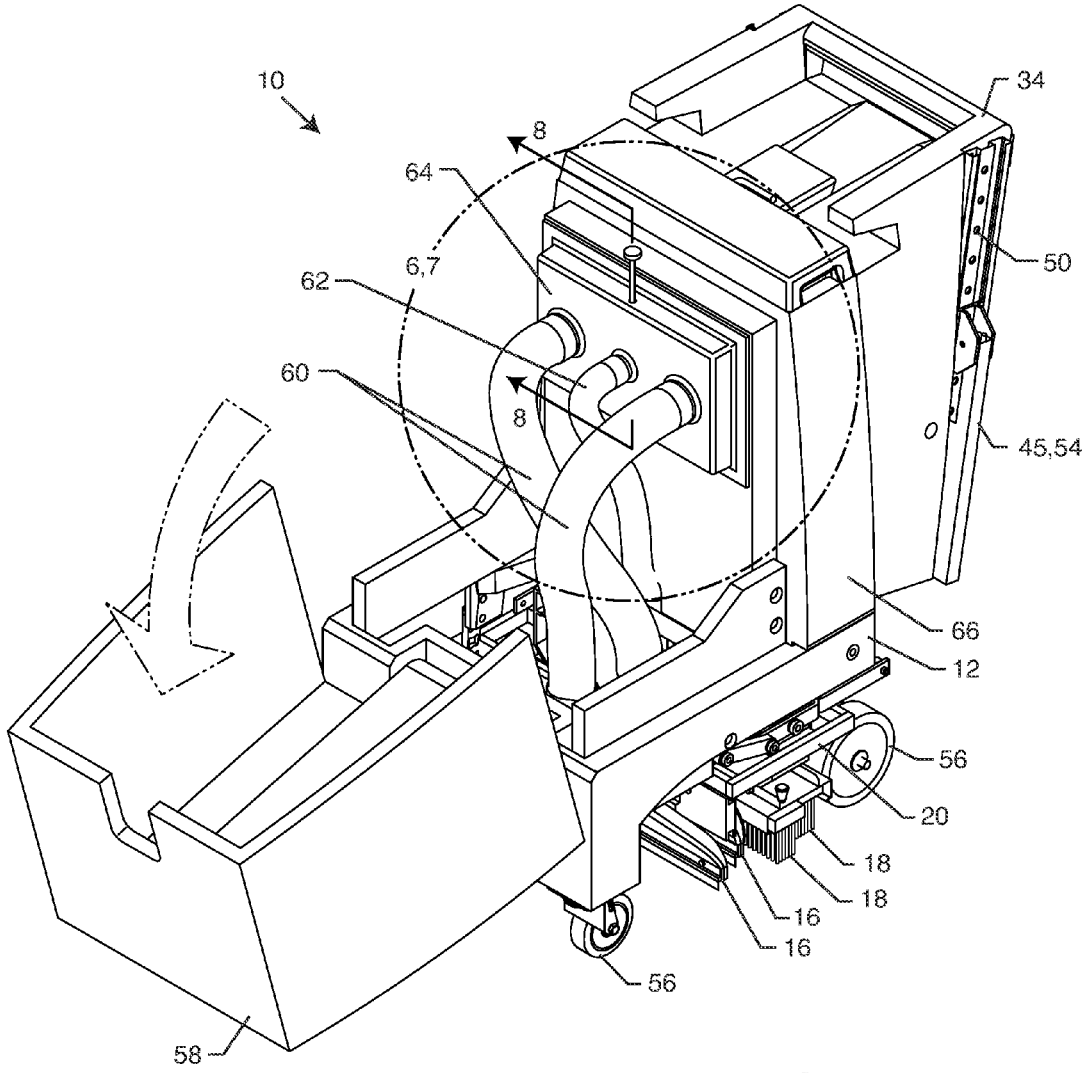
FIG. 5 is a perspective view of the structure of FIG. 1, now showing a front cover opened.
Figure 6:
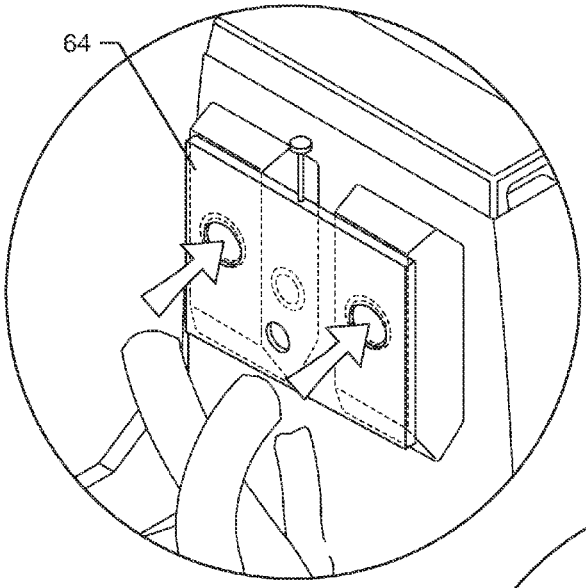
FIG. 6 is an enlarged view of the structure of FIG. 5 taken along line 6 and 7.
Figure 7:
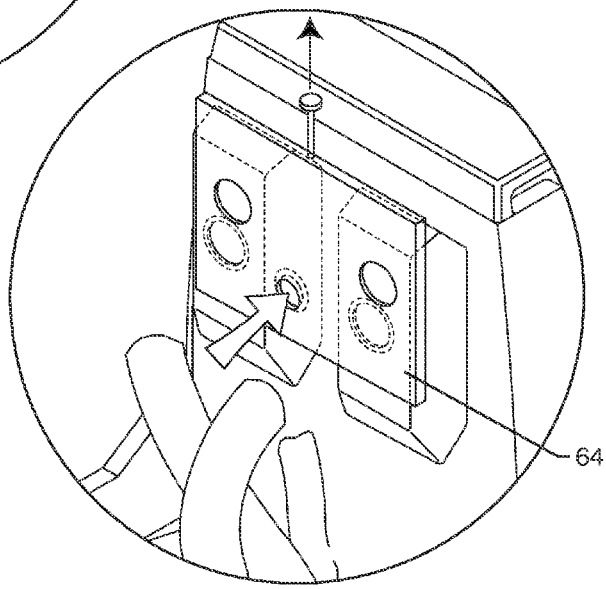
FIG. 7 is an enlarged view of the structure of FIG. 5 taken along line 6 and 7 now with a suction to the auxiliary hose.
Figure 8:
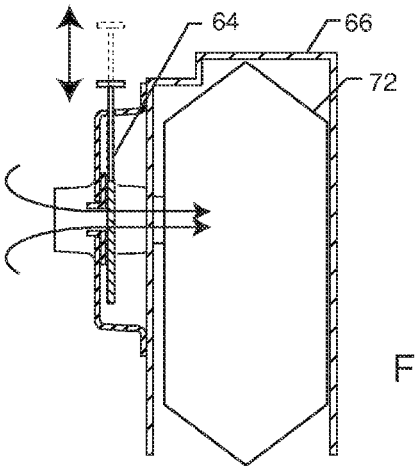
FIG. 8 is a side view of the structure of FIG. 5 taken along line 8-8.
Figure 9:
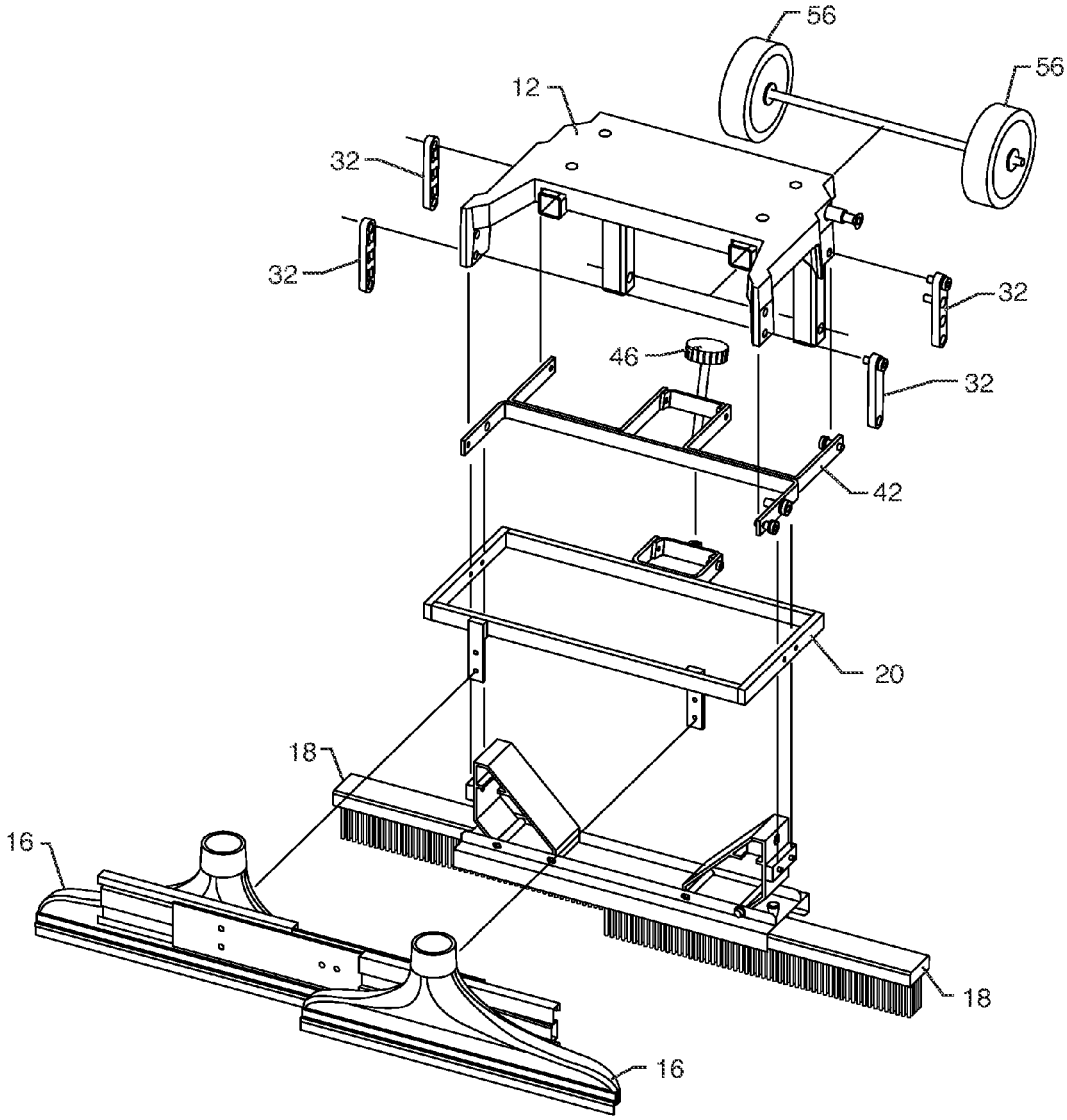
FIG. 9 is an enlarged and exploded perspective view of a carriage assembly.
Figure 10:
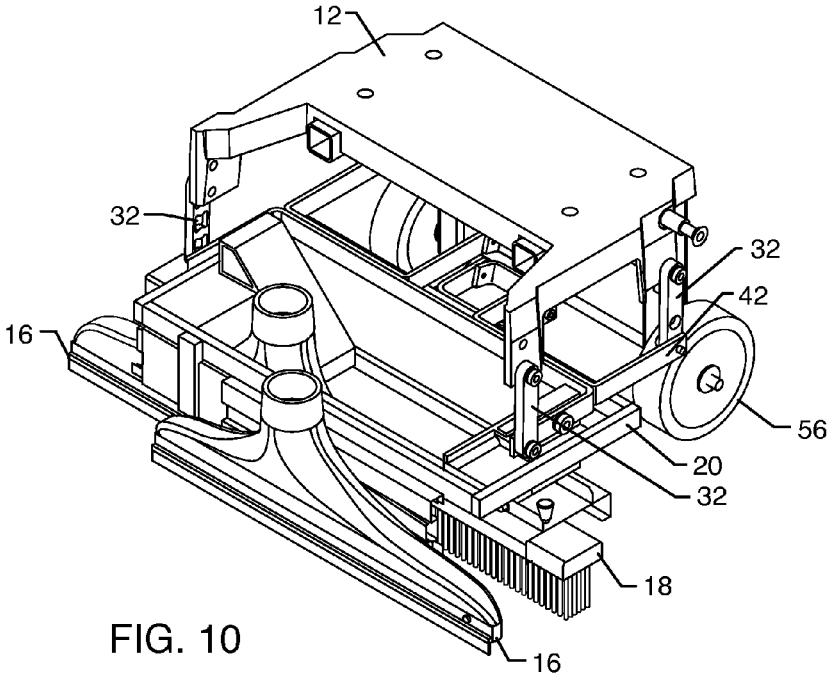
FIG. 10 is an enlarged perspective view of the structure of the carriage assembly of FIG. 9 now assembled.
Figure 11:
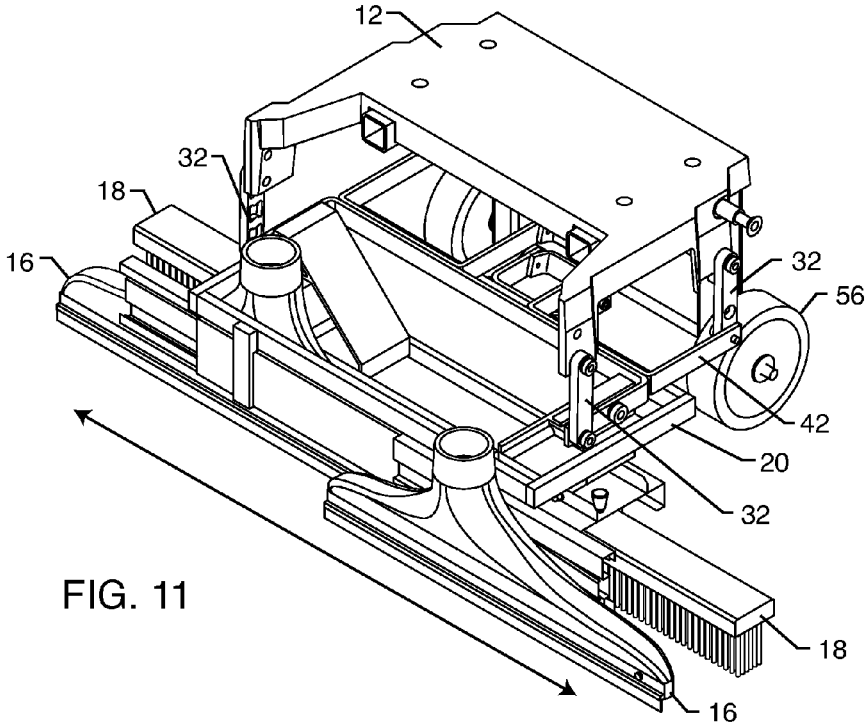
FIG. 11 is a view similar to FIG. 10, now showing a vacuum head and brush head slidably deployed.

FIG. 1 shows the device 10 with a front cover 58 closed. FIG. 5 shows the front cover 58 open exposing various vacuum hoses. Vacuum hoses 60 are connected to each slidable vacuum head 16. An auxiliary vacuum hose 62 can be associated with the vacuum pumps 14 for manually vacuuming a debris. Sometimes it may be necessary to manually vacuum various debris that the vacuum heads 16 did not collect, and the auxiliary vacuum hose 62 facilitates this added flexibility. To vary the suction between the vacuum heads 16 and the auxiliary vacuum hose 62, a moveable switch plate 64 can be associated with the plurality of vacuum heads 16 and the auxiliary vacuum hose 62. Movement of the switch plate 64 allows a suction to be varied between the plurality of vacuum heads 16 and the auxiliary vacuum hose 62. Said differently, a means for switching a suction between the plurality of vacuum heads 16 and the auxiliary vacuum hose 62 can be facilitated. The switch plate 64 is simply a plate that has apertures that allow suction to pass through. When the switch plate 64 is in one position it allows the suction to flow through the hoses 60 to the suction chamber 66, as is shown in FIG. 6. When the switch plate 64 is in a second position, it blocks airflow to the hoses 60 and allows it to flow to the auxiliary hose 62, as is shown in FIG. 7. FIG. 8 is a side view of FIGS. 6 and 7 and shows how a suction can flow into the suction chamber 66 and into a vacuum bag 72. The vacuum bag can then collect debris from the vacuum heads 16 or auxiliary vacuum hose 62. Only one vacuum bag 72 is shown, however each vacuum head 16 can have its own bag 72. As can be seen, many methods and techniques can be utilized by one skilled in the art for switch the suction between hoses and this disclosure is not intended to limit it to the precise form described herein.

In an exemplary embodiment a sprayer 68 can be associated with the frame 12 for manually distributing a cleaning fluid, best shown in FIG. 3. Sometimes the walkway can be manually sprayed with cleaning fluid to help emulsify and loosen stubborn dirt and debris. The sprayer 68 can be integrated within the frame 12 for added versatility. In these exemplary embodiments the auxiliary vacuum hose 62 is wrapped around a fluid tank 74 that contains the cleaning fluid.

At least one of the plurality of brush heads 18 can be interchangeable. In an exemplary embodiment the inside of the handle 34 can store additional brush heads 70. Additional brush heads 70 allow different brush heads 18 to be used for different cleaning techniques. Some grooves 30 are more fragile and require softer bristles. Other grooves 30 are made from a strong metallic and can be abrasively cleaned. Therefore, it is very convenient for the device to contain a plurality of additional brush heads 70.

Figure 19:
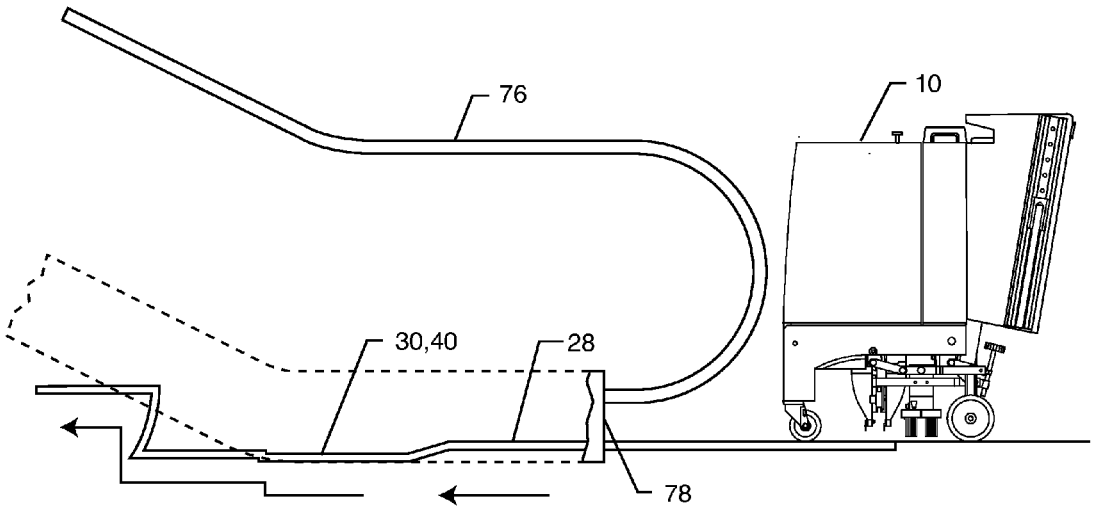
FIG. 19 is a side view of the exemplary device of FIG. 1 just before being positioned to clean the moving transport.
Figure 20:
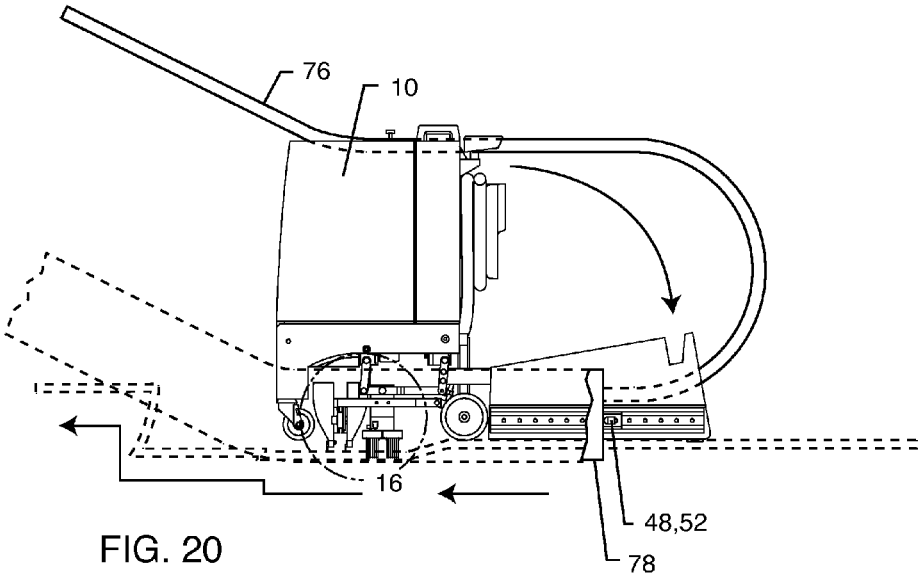
FIG. 20 is a side view of the exemplary device of FIG. 1 cleaning the moving transport.

FIG. 19 is a side view of the exemplary device of FIG. 1 just before being positioned to clean an escalator/moving transport 76. FIG. 20 is a side view of the exemplary device of FIG. 1 cleaning the escalator/moving transport 76. A base of a railing 78 can be seen where it abuts the rail support 48 in an extended position 52. This prevents the motion of the escalator 76 from transporting the device 10.

Although several embodiments have been described in detail for purposes of illustration, various modifications may be made to each without departing from the scope and spirit of the invention. Accordingly, the invention is not to be limited, except as by the appended claims.

What is claimed is:

1. A device for cleaning grooved surfaces of a moving transport, including escalators and moving walkways, comprising:

a frame supporting a carriage and a vacuum pump, including a handle pivotally attached to the frame and a rail support pivotally attached to the handle, wherein the rail support is configured to abut a base of a pair of railings of the moving transport preventing movement of the device when the handle is in a down position and the rail support is in an extended position;

a plurality of vacuum heads associated with the vacuum pump, wherein at least one of the plurality of vacuum heads is slidably attached to the carriage; and a brush head associated with the plurality of vacuum heads.

2. The device of claim 1, wherein the brush head includes a plurality of brush heads.

3. The device of claim 2, wherein at least one of the plurality of brush heads is slidably attached to the carriage.

4. The device of claim 3, wherein the carriage is angularly adjustable to align with a horizontal plane of the grooved surface.

5. The device of claim 3, wherein the at least one of the plurality of brush heads are interchangeable, such that different brush heads may be utilized for different cleaning techniques.

6. The device of claim 1, wherein the carriage is attached to the frame and is positionable between a stored position and a deployed position.

7. The device of claim 6, wherein the carriage is angularly adjustable to align with a horizontal plane of the grooved surface.

8. The device of claim 6, wherein pivotable movement of the handle is mechanically coupled to movement of the carriage between the stored and deployable positions.

9. The device of claim 8, wherein the handle in the down position corresponds to the deployed position of the carriage, and wherein the handle in an up position corresponds to the stored position of the carriage.

10. The device of claim 1, wherein the rail support is slidably positionable along a length of the handle.

11. The device of claim 1, including at least one wheel attached relative to the frame configured for positioning the device between the pair of railings of the moving transport.

12. The device of claim 1, including a vacuum bag associated with the vacuum pump.

13. The device of claim 1, including an auxiliary vacuum hose associated with the vacuum pump for manually vacuuming a debris.

14. The device of claim 13, including a moveable switch plate associated with the plurality of vacuum heads and the auxiliary vacuum hose.

15. The device of claim 14, wherein movement of the switch plate allows a suction to be varied between the plurality of vacuum heads and the auxiliary vacuum hose.

16. The device of claim 13, including means for switching a suction between the plurality of vacuum heads and the auxiliary vacuum hose.

17. The device of claim 1, including a sprayer associated with the frame for manually distributing a cleaning fluid.

18. The device of claim 1, wherein the carriage comprises an intermediate support connected to the frame through a four-bar linkage assembly.

19. The device of claim 18, wherein the carriage is pivotably attached to the intermediate support and is angularly adjustable to align with a horizontal plane of the grooved surface.

20. A device for cleaning grooved surfaces of a moving transport, including escalators and moving walkways, comprising:

a frame, including a handle pivotally attached to the frame and a rail support pivotally attached to and slidably positionable along a length of the handle, wherein the rail support is configured to abut a base of a pair of railings of the moving transport preventing movement of the device when the handle is in a down position and the rail support is in an extended position;

a vacuum pump supported within the frame;

a plurality of vacuum heads associated with the vacuum pump;

a plurality of brush heads associated with the plurality of vacuum heads; and a carriage to which at least one of the plurality of vacuum heads and one of the plurality of brush heads are slidably attached.

21. The device of claim 20, wherein the carriage is moveably attached to the frame and is positionable between a stored position and a deployed position.

22. The device of claim 21, wherein the carriage is angularly adjustable to align with a horizontal plane of the grooved surfaces.

23. The device of claim 22, wherein pivotable movement of the handle is mechanically coupled to movement of the carriage between the stored and deployable positions.

24. The device of claim 23, wherein the handle in the down position corresponds to the deployed position of the carriage, and wherein the handle in an up position corresponds to the stored position of the carriage.

25. A device for cleaning grooved surfaces of a moving transport, including escalators and moving walkways, comprising:

a frame having a fixed width and supporting a vacuum pump and a carriage;

a plurality of vacuum heads attached to the carriage and associated with the vacuum pump, wherein the plurality of vacuum heads are disposed one in front of another relative to a direction of movement of the moving transport and are coextensive with the fixed width of the frame, wherein a first of the plurality of vacuum heads is slidably attached to the carriage so as be laterally displaceable outside the fixed width of the frame; and a plurality of brush heads attached to the carriage and each associated with one of the plurality of vacuum heads.

26. The device of claim 25, wherein a second of the plurality of vacuum heads is slidably attached to the carriage so as to be laterally displaceable outside the fixed width of the frame in an opposite direction to the first of the plurality of vacuum heads.

27. The device of claims 25 or 26, wherein a first of the plurality of brush heads is slidably attached to the carriage so as to be laterally displaceable outside the fixed width of the frame in the same direction as the first of the plurality of vacuum heads.

28. The device of claim 27, wherein a second of the plurality of brush heads is slidably attached to the carriage so as to be laterally displaceable outside the fixed width of the frame in the direction opposite to the first of the plurality of vacuum heads.

29. The device of claim 25, wherein the carriage is angularly adjustable to align with a horizontal plane of the grooved surface and is positionable between a stored position and a deployed position.

30. The device of claim 29, wherein the carriage comprises an intermediate support connected to the frame through a four-bar linkage assembly.

31. The device of claim 29, including a handle pivotally attached to the frame and mechanically coupled to movement of the carriage, wherein the handle in a down position corresponds to the deployed position of the carriage and the handle in an up position corresponds to the stored position of the carriage.

32. The device of claim 31, further comprising a rail support pivotally attached to the handle, wherein the rail support is slidably positionable along a length of the handle and is configured to abut a base of a pair of railings of the moving transport preventing movement of the device when the handle is in a down position and the rail support is in an extended position.

33. The device of claim 25, including at least one wheel attached relative to the frame configured for positioning the device between a pair of railings of the moving transport.

34. The device of claim 25, including an auxiliary vacuum hose associated with the vacuum pump for manually vacuuming debris, and a moveable switch plate associated with the plurality of vacuum heads and the auxiliary vacuum hose, wherein movement of the switch plate allows suction to be varied between the plurality of vacuum heads and the auxiliary vacuum hose, including means for switching the suction between the plurality of vacuum heads and the auxiliary vacuum hose.

35. The device of claim 25, including a sprayer associated with the frame for manually distributing a cleaning fluid.

36. The device of claim 25, wherein the plurality of brush heads are interchangeable, such that different brush heads may be utilized for different cleaning techniques.

* * * * *